US010350882B2

(12) United States Patent
Misawa et al.

(10) Patent No.: US 10,350,882 B2
(45) Date of Patent: Jul. 16, 2019

(54) LIQUID EJECTION DEVICE AND INKJET RECORDING INCLUDING THE SAME

(71) Applicant: Roland DG Corporation, Hamamatsu-shi, Shizuoka (JP)

(72) Inventors: Keisuke Misawa, Hamamatsu (JP); Takashi Makinose, Hamamatsu (JP); Kenji Kawagoe, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 3 days.

(21) Appl. No.: 15/374,040

(22) Filed: Dec. 9, 2016

(65) Prior Publication Data

US 2017/0165964 A1 Jun. 15, 2017

(30) Foreign Application Priority Data

Dec. 11, 2015 (JP) ..... 2015-242589

(51) Int. Cl.
*B41J 2/045* (2006.01)

(52) U.S. Cl.
CPC ..... *B41J 2/04541* (2013.01); *B41J 2/04516* (2013.01); *B41J 2/04581* (2013.01); *B41J 2/04588* (2013.01)

(58) Field of Classification Search
None
See application file for complete search history.

(56) References Cited

U.S. PATENT DOCUMENTS

| | | | | |
|---|---|---|---|---|
| 6,382,753 | B1 | 5/2002 | Teramae et al. | |
| 2014/0022294 | A1* | 1/2014 | Satou | B41J 2/04588 347/10 |
| 2014/0240384 | A1 | 8/2014 | Yokomaku | |

FOREIGN PATENT DOCUMENTS

| | | | |
|---|---|---|---|
| EP | 0 738 602 | A2 | 10/1996 |
| JP | 05-193127 | A | 8/1993 |
| JP | 09-52360 | A | 2/1997 |
| JP | 10-024570 | A | 1/1998 |
| JP | 10-081012 | A | 3/1998 |
| JP | 2001-191526 | A | 7/2001 |
| JP | 2002-225253 | A | 8/2002 |
| JP | 3389859 | B2 | 3/2003 |
| JP | 2008-062548 | A | 3/2008 |
| JP | 2014-162221 | A | 9/2014 |

* cited by examiner

*Primary Examiner* — Alejandro Valencia
(74) *Attorney, Agent, or Firm* — Keating & Bennett, LLP

(57) ABSTRACT

A liquid injection device includes a liquid injection head and a controller including a driving signal generator generating a driving signal including, in one liquid drop injection period, a first driving pulse and a second driving pulse, and a driving signal supplier. The first driving pulse maintains the pressure chamber in an expanded state for a time period of about (½)×Tc; and the second driving pulse starts at a timing that is about n×Tc after the start of the first driving pulse, n being an integer satisfying n≥2, to maintain the pressure chamber in the expanded state for the time period of about (½)×Tc, and to inject the second liquid drop at a speed higher than, or equal to, a speed at which the first liquid drop is injected.

8 Claims, 6 Drawing Sheets

LIQUID EJECTION DEVICE AND INKJET RECORDING INCLUDING THE SAME

CROSS REFERENCE TO RELATED APPLICATIONS

This application claims the benefit of priority to Japanese Patent Application No. 2015-242589 filed on Dec. 11, 2015. The entire contents of this application are hereby incorporated herein by reference.

BACKGROUND OF THE INVENTION

1. Field of the Invention

The present invention relates to a liquid injection device and an inkjet recording device including the same, and more specifically, to a control technology for liquid injection using a so-called multi-dot system.

2. Description of the Related Art

A liquid injection device used for an inkjet recording device or the like includes a liquid injection head injecting a liquid drop and a control device controlling the liquid injection head. For example, an ink injection head in an inkjet recording device includes a pressure chamber temporarily storing ink, an actuator that is in contact with the pressure chamber and includes a piezoelectric element, and a nozzle that is in communication with the pressure chamber and injects an ink drop toward a recording medium such as a recording paper sheet or the like. Such an inkjet recording device is operated as follows. When a driving pulse is transmitted to the actuator, the piezoelectric element is contracted or extended based on the driving pulse. As a result, the interior of the pressure chamber is expanded or contracted to inject ink in the pressure chamber from the nozzle. The injected ink drop lands on the recording medium, and thus one dot (drop corresponding to one pixel) is formed on the recording medium.

In such an inkjet recording device, there is a limit on the amount of liquid contained in one liquid drop that can be stably injected by one driving pulse. Thus, various studies have been made conventionally in order to realize gray scale printing. For example, Japanese Laid-Open Patent Publication No. Hei 10-81012 discloses a method for driving an ink injection head by which the size of dots is adjusted by a multi-dot system. By the multi-dot system, a driving signal including a plurality of driving pulses in one liquid drop injection period for forming one dot is generated. From the plurality of driving pulses, one or at least two driving pulses are selected in accordance with the size of the dot, and are supplied to the actuator driving the ink injection head. For example, for forming a relatively large dot, a first ink drop and a second ink drop are injected in a time-series manner in one liquid drop injection period. Before landing on the recording medium, the first ink drop and the second ink drop are merged.

However, in the ink injection device having the above-described structure, after the second ink drop (main drop) is injected from the nozzle, a satellite leading to a meniscus that forms an ink surface in the nozzle may be generated from the main drop. If being separated from the main drop, the satellite may jump as a satellite drop and land at a position away from the main drop on the recording medium. In the case of moving slowly, the satellite drop may lose a kinetic energy thereof by the influence of the air flow or the resistance of the air, and may become ink mist (microscopic ink drops floating in a disorderly manner) to stain the inside of the recording device or the recording medium. The satellite drop or the ink mist is easily generated in the case where, for example, a printing gap is enlarged in order to inject a large liquid drop or the driving frequency is increased in order to print at a high speed. Therefore, in the case where the printing gap is to be enlarged or the throughput is to be increased, it is desired to more effectively suppress or prevent the long satellite drop or the ink mist.

SUMMARY OF THE INVENTION

Preferred embodiments of the present invention provide a liquid injecting device that suppresses or prevents the generation of a long satellite drop or ink mist and injects a liquid drop of a desired size stably. Preferred embodiments of the present invention also provide an inkjet recording device including the liquid injection device.

A liquid injection device according to a preferred embodiment of the present invention includes a liquid injection head injecting a liquid drop; and a controller controlling the liquid injection head. The liquid injection head includes a hollow case main body provided with an opening; a vibration plate attached to the case main body so as to cover the opening, the vibration plate defining a pressure chamber together with the case main body; a pressure generator coupled with the vibration plate and located to expand and contract the pressure chamber; and a nozzle provided in the case main body so as to be in communication with the pressure chamber, the nozzle allowing a liquid to flow out therefrom. The controller includes a driving signal generator generating a driving signal including, in one liquid drop injection period, a first driving pulse to expand and contract the pressure chamber to inject a first liquid drop and a second driving pulse to expand and contract the pressure chamber to inject a second liquid drop; and a driving signal supplier supplying the driving signal to the pressure generator of the liquid injection head. Tc is a Helmholtz characteristic vibration period of the liquid injection head. The first driving pulse maintains the pressure chamber in an expanded state for a time period of about $(1/2)\times Tc$; and the second driving pulse starts at a timing that is about $n\times Tc$ after the start of the first driving pulse, n being an integer satisfying $n\geq 2$, to maintain the pressure chamber in the expanded state for the time period of about $(1/2)\times Tc$, and to inject the second liquid drop at a speed higher than, or equal to, a speed at which the first liquid drop is injected.

In the above-described liquid injection device, the first driving pulse and the second driving pulse switch the pressure chamber from an expanded state to a contracted state preferably at a timing of about $(1/2)\times Tc$. Thus, each of the driving pulses acts to amplify the Helmholtz characteristic vibration. As a result, the injection stability of the liquid drop is increased, and the expansion and contraction amount of the pressure chamber is increased. Thus, a larger liquid drop is injected. In the above-described liquid injection device, the timing at which the second driving pulse starts is preferably set to about $2\times Tc$ ($n\geq 2$) after the start of the first driving pulse. This decreases the amount by which the meniscus is pulled after the first liquid drop is injected, and a large second liquid drop having a large liquid amount is injected stably. In the liquid injection device, the second liquid drop is injected at a speed higher than, or equal to, the speed at which the first liquid drop is injected. This allows the first liquid drop and the second liquid drop to merge appropriately. Since the speed at which the second liquid drop is injected is increased, generation of a satellite drop or mist is better suppressed or prevented. For the above-described reasons, the liquid injection device generates a dot of a desired size with high precision even if, for example, the printing gap is to be enlarged or the throughput is to be increased.

In another preferred embodiment of the present invention, an inkjet recording device including the above-described liquid injection device is provided. The inkjet recording device generates even a dot of a large size stably by a multi-dot system. Therefore, for example, the variance in the dot diameter or the position at which the liquid drop lands is decreased or prevented, and thus the printing quality is improved. The stain on the recording medium caused by the satellite drop or mist is alleviated.

Liquid injection devices according to preferred embodiments of the present invention suppress or prevent the generation of a long satellite drop or mist, and generate a dot of a desired size stably. Therefore, the injection stability of, for example, a large liquid drop is improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, liquid injection devices and inkjet recording devices according to preferred embodiments of the present invention will be described with reference to the drawings. The preferred embodiments described herein do not limit the present invention in any way. Components or portions having the same function will bear the same reference signs, and overlapping descriptions will be omitted or simplified.

Figure 1:
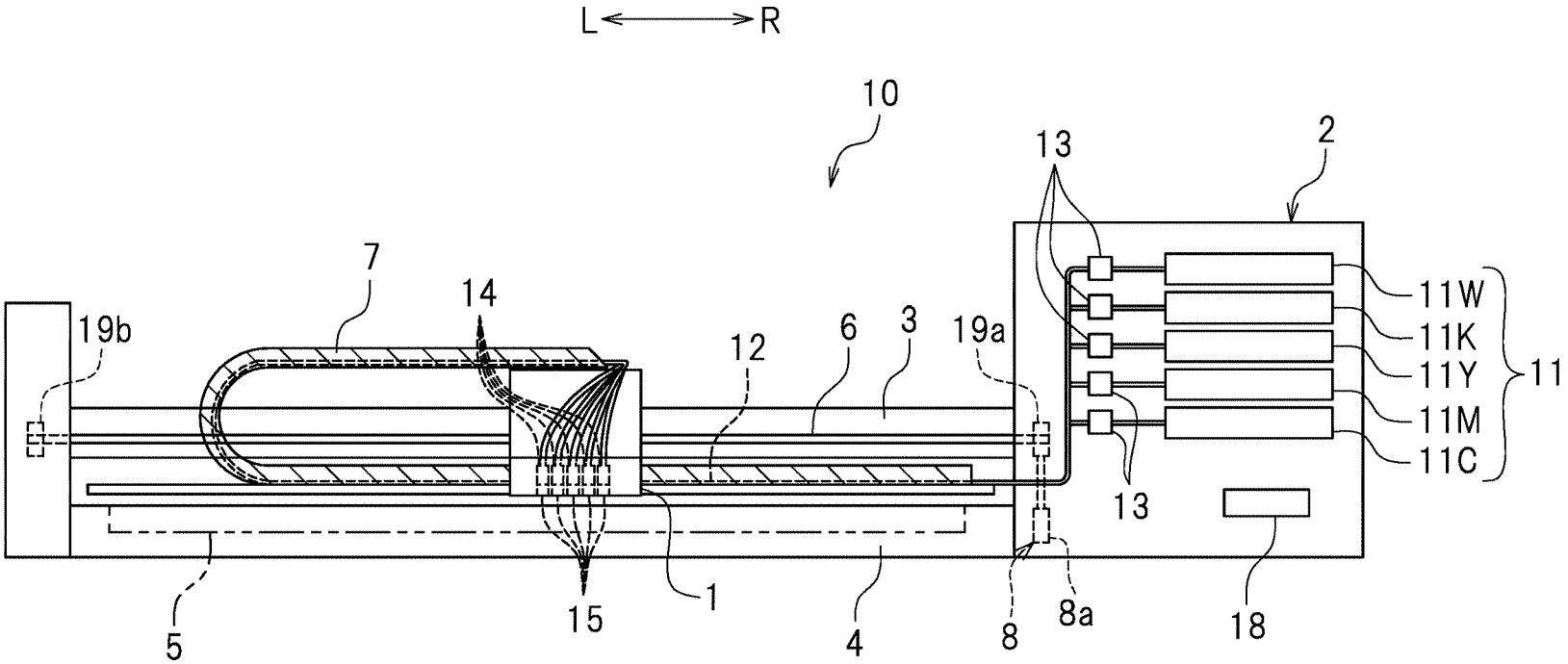
FIG. 1 is a front view of an inkjet printer according to a preferred embodiment of the present invention.

First, an inkjet recording device will be described. FIG. 1 is a front view of a large inkjet printer (hereinafter, referred to as the "printer") 10 according to a preferred embodiment of the present invention. The printer 10 is an example of an inkjet recording device. In FIG. 1 and the like, the letters "L" and "R" respectively refer to left and right. In FIG. 1, the side closer to the viewer of FIG. 1 and the side farther from the viewer of FIG. 1 are respectively the front side and the rear side. It should be noted that these directions are defined merely for the sake of convenience, and do not limit the manner of installation of the printer 10 in any way.

The printer 10 is to perform printing on a recording paper sheet 5, which is a recording medium. The "recording medium" encompasses recording mediums formed of paper including plain paper and the like, resin materials including polyvinyl chloride (PVC), polyester and the like, and various other materials including aluminum, iron, wood and the like.

The printer 10 includes a printer main body 2, and a guide rail 3 secured to the printer main body 2. The guide rail 3 extends in a left-right direction. The guide rail 3 is in engagement with a carriage 1 provided with damper devices 14 and ink injection heads 15. The carriage 1 moves reciprocally in the left-right direction (scanning direction) along the guide rail 3 by a carriage moving mechanism 8. The carriage moving mechanism 8 includes rollers 19*a* and 19*b* provided at a right end and a left end of the guide rail 3. The roller 19*a* is coupled with a carriage motor 8*a*. The carriage motor 8*a* may be coupled with the roller 19*b*. The roller 19*a* is driven to rotate by the carriage motor 8*a*. An endless belt 6 extends along, and between, the rollers 19*a* and 19*b*. The carriage 1 is secured to the endless belt 6. When the rollers 19*a* and 19*b* are rotated and thus the belt 6 runs, the carriage 1 moves in the left-right direction.

The printer 10 preferably is larger than, for example, a table-top printer for home use. For the printer 10, the scanning speed of the carriage 1 may preferably be occasionally set to be relatively high from the point of view of increasing the throughput although the scanning speed is set also in consideration of resolution. For example, the scanning speed may be preferably set to about 600 mm/s to about 900 mm/s when the driving frequency is about 14 kHz. For higher-speed operation, the scanning speed may be set to about 1000 mm/s or greater, for example, about 1100 mm/s to about 1200 mm/s, when the driving frequency is about 20 kHz. In such a case, the interval between injections of ink drops is significantly short. Therefore, the technology disclosed herein is especially effective for the printer 10.

The printing paper sheet 5 is transported in a paper feeding direction by a paper feeding mechanism (not shown). In this example, the paper feeding direction is a front-rear direction. The printer main body 2 includes a platen 4 supporting the recording paper sheet 5. The platen 4 includes a grid roller (not shown). A pinch roller (not shown) is provided above the grid roller. The grid roller is coupled with a feed motor (not shown). The grid roller is driven to rotate by the feed motor. When the grid roller is rotated in a state where the recording paper sheet 5 is held between the grid roller and the pinch roller, the recording paper sheet 5 is transported in the front-rear direction.

The printer main body 2 is provided with an ink cartridge 11. The ink cartridge 11 is a tank storing ink. In the preferred embodiment shown in FIG. 1, a plurality of ink cartridges 11C, 11M, 11Y, 11K and 11W are detachably attached to the printer main body 2. The ink cartridge 11C stores cyan ink. The ink cartridge 11M stores magenta ink. The ink cartridge 11Y stores yellow ink. The ink cartridge 11K stores black ink. The ink cartridge 11W stores white ink.

The printer 10 includes an ink supply system for each of the ink cartridges 11C, 11M, 11Y, 11K and 11W of the respective colors. Hereinafter, a structure of the ink supply system provided for the ink cartridge 11C will be specifically explained as an example. The ink supply system for the ink cartridge 11C includes an ink supply path 12, a liquid transmission pump 13, the damper device 14, the ink injection head 15, and a controller 18. The ink supply path 12 is an ink flow path guiding the ink from the ink cartridge 11C to the ink injection head 15. The ink supply path 12 is, for example, a resin deformable tube. The liquid transmission pump 13 is an example of a liquid transmission device that supplies the ink from the ink cartridge 11C toward the ink injection head 15. The liquid transmission pump 13 is provided on the ink supply path 12. The liquid transmission pump 13 is a so-called tube pump of, for example, a trochoid pump system. The liquid transmission pump 13 is connected with the controller 18. The damper device 14 is in communication with the ink injection head 15, and supplements the ink supplied to the ink injection head 15. The damper device 14 also alleviates the pressure fluctuation of the ink to stabilize the ink injection operation of the ink injection head 15.

The damper device 14 and the ink injection head 15 are mounted on the carriage 1, and move in the left-right direction. By contrast, the ink cartridge 11C is not mounted on the carriage 1, and does not reciprocally move in the left-right direction. A majority of the ink supply path 12 extends in the left-right direction so as not to be broken even when the carriage 1 moves in the left-right direction. In this preferred embodiment, five types of ink preferably are used, and therefore, a total of five ink supply paths 12 are provided, for example. The ink supply paths 12 are covered with a cable protection and guide device 7. The cable protection and guide device 7 is, for example, a cableveyor (registered trademark).

Figure 2:
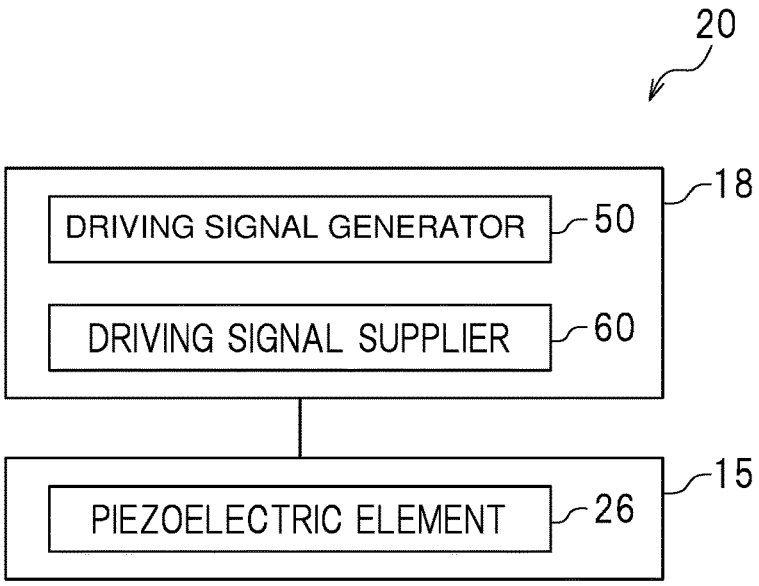
FIG. 2 is a block diagram showing a structure of an ink injection device.

The printer 10 includes an ink injection device 20 as an ink injection mechanism. FIG. 2 is a block diagram showing a structure of the ink injection device 20. The ink injection device 20 includes the ink injection head 15 injecting the ink and the controller 18 controlling an operation of the ink injection head 15.

The ink injection head 15 is to perform printing on the recording paper sheet 5. Specifically, the ink injection head 15 is to inject an ink drop having a predetermined size toward the recording paper sheet 5 to form a dot on the recording paper sheet 5. The ink injection head 15 includes a plurality of nozzles 25 (see FIG. 3) injecting ink. The nozzles 25 are provided on a surface of the ink injection head 15 that faces the recording paper sheet 5. The plurality of nozzles 25 are arrayed at a predetermined pitch corresponding to the dot formation density (for example, arrayed at 360 dpi). The ink injection head 15 is an example of a liquid injection head.

Figure 3:
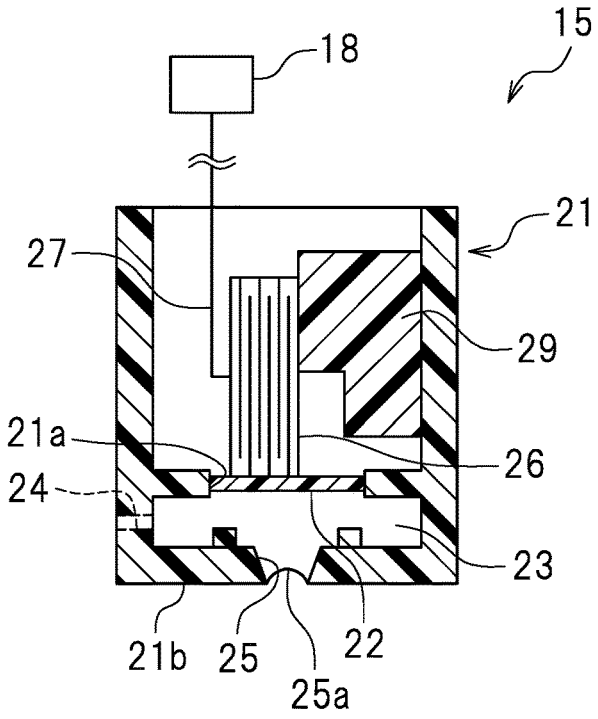
FIG. 3 is a partial cross-sectional view of a nozzle and the vicinity thereof of an ink injection head.

FIG. 3 is a partial cross-sectional view of one nozzle 25 and the vicinity thereof of the ink injection head 15. As shown in FIG. 3, the ink injection head 15 includes a hollow case main body 21 provided with an opening 21*a*, and a vibration plate 22 attached to the case main body 21 so as to cover the opening 21*a*. The vibration plate 22 demarcates a portion of a pressure chamber 23. An area enclosed by the case main body 21 and the vibration plate 22 is the pressure chamber 23. The case main body 21 is preferably formed of a resin, for example. The vibration plate 22 may be any component elastically deformable to the inside and the outside of the pressure chamber 23. The "inside" and the "outside" of the pressure chamber 23 respectively refer to the top side and the bottom side in FIG. 3. The vibration plate 22 is typically a resin film.

A surface of the case main body 21 (left surface in FIG. 3) is provided with an ink inlet 24. The ink inlet 24 allows the ink to flow into the case main body 21. The ink inlet 24 merely needs to be in communication with the pressure chamber 23, and there is no limitation on the position of the ink inlet 24. The ink inlet 24 is in communication with the ink cartridge 11C. The ink is supplied to the pressure chamber 23 via the ink inlet 24, and the ink of a predetermined amount is temporarily stored in the pressure chamber 23. A bottom surface 21*b* of the case main body 21 is provided with the nozzle 25 injecting the ink. The nozzle 25 injects an ink drop toward the recording paper sheet 5. A liquid surface (free surface) inside the nozzle 25 forms a meniscus 25*a*.

The pressure chamber 23 has the Helmholtz characteristic vibration period Tc. The Helmholtz characteristic vibration period Tc is uniquely specified by the material, size, shape or location of each of components defining the pressure chamber 23, for example, the case main body 21 and the vibration plate 22, the opening area size of the nozzle 25, physical properties (e.g., viscosity) of the ink, and the like. The Helmholtz characteristic vibration period Tc is a vibration period characteristic to the ink injection head 15. The Helmholtz characteristic vibration period Tc preferably is, for example, a vibration period of several microseconds to several ten microseconds. After an ink drop is injected, the pressure chamber 23 has a residual vibration having such a vibration period.

A piezoelectric element 26 is in contact with a surface of the vibration plate 22 opposite to the pressure chamber 23. An end of the piezoelectric element 26 is secured to a secured member 29. The piezoelectric element 26 is a type of actuator. The piezoelectric element 26 is connected with the controller 18 via a flexible cable 27. The piezoelectric element 26 is supplied with a driving signal or the like via the flexible cable 27. In this preferred embodiment, the piezoelectric element 26 is a stack body including a piezoelectric material layer and a conductive layer stacked alternately. The piezoelectric element 26 is extended or contracted based on the driving signal supplied thereto by the controller 18 to act to elastically deform the vibration plate 22 to the inside or to the outside of the pressure chamber 23. In this example, the piezoelectric element 26 is a piezoelectric transducer (PZT) of a longitudinal vibration mode. The PZT of the longitudinal vibration mode is extendable in the stacking direction, and, for example, is contracted when being discharged and is extended when being charged. There is no specific limitation on the type of the piezoelectric element 26. The actuator is not limited to the piezoelectric element 26.

In the ink injection head 15 having the above-described structure, the piezoelectric element 26 is contracted by, for example, a decrease in the potential thereof from an intermediate level. When this occurs, the vibration plate 22 follows this contraction to be elastically deformed to the outside of the pressure chamber 23 from an initial position, and thus the pressure chamber 23 is expanded. The expression that the "pressure chamber 23 is expanded" refers to that the capacity of the pressure chamber 23 is increased by the deformation of the vibration plate 22. Next, the potential of the piezoelectric element 26 is increased to extend the piezoelectric element 26 in the stacking direction. As a result, the vibration plate 22 is elastically deformed to the inside of the pressure chamber 23, and thus the pressure chamber 23 is contracted. The expression that the "pressure chamber 23 is contracted" refers to that the capacity of the pressure chamber 23 is decreased by the deformation of the vibration plate 22. Such expansion/contraction of the pressure chamber 23 changes the pressure inside the pressure chamber 23. Such a change in the pressure inside the pressure chamber 23 pressurizes the ink in the pressure chamber 23, and the ink is injected from the nozzle 25 as an ink drop. Then, the potential of the piezoelectric element 26 is returned to the intermediate level, so that the vibration plate 22 returns to the initial position and the pressure chamber 23 is expanded. At this point, the ink flows into the pressure chamber 23 via the ink inlet 24. In this preferred embodiment, the ink injection head 15 including the piezoelectric element 26 as shown in FIG. 3 continuously injects two ink drops (first ink drop and second ink drop) in a preset unit period (one liquid drop injection period) in order to form one dot.

The controller 18 is connected with the carriage motor 8*a* of the carriage moving mechanism 8, the feed motor of the paper feeding mechanism, the liquid transmission pump 13, and the ink injection head 15. The controller 18 is configured or programmed to control operations of these components. The controller 18 is typically a computer. The controller 18 includes, for example, an interface (I/F) receiving printing data or the like from an external device such as a host computer or the like, a central processing unit (CPU) executing a command of a control program, a ROM storing the program to be executed by the CPU, a RAM usable as a working area in which the program is developed, and a storage device (storage medium) such as a memory or the like storing the above-described program and various other types of data.

Figure 4:
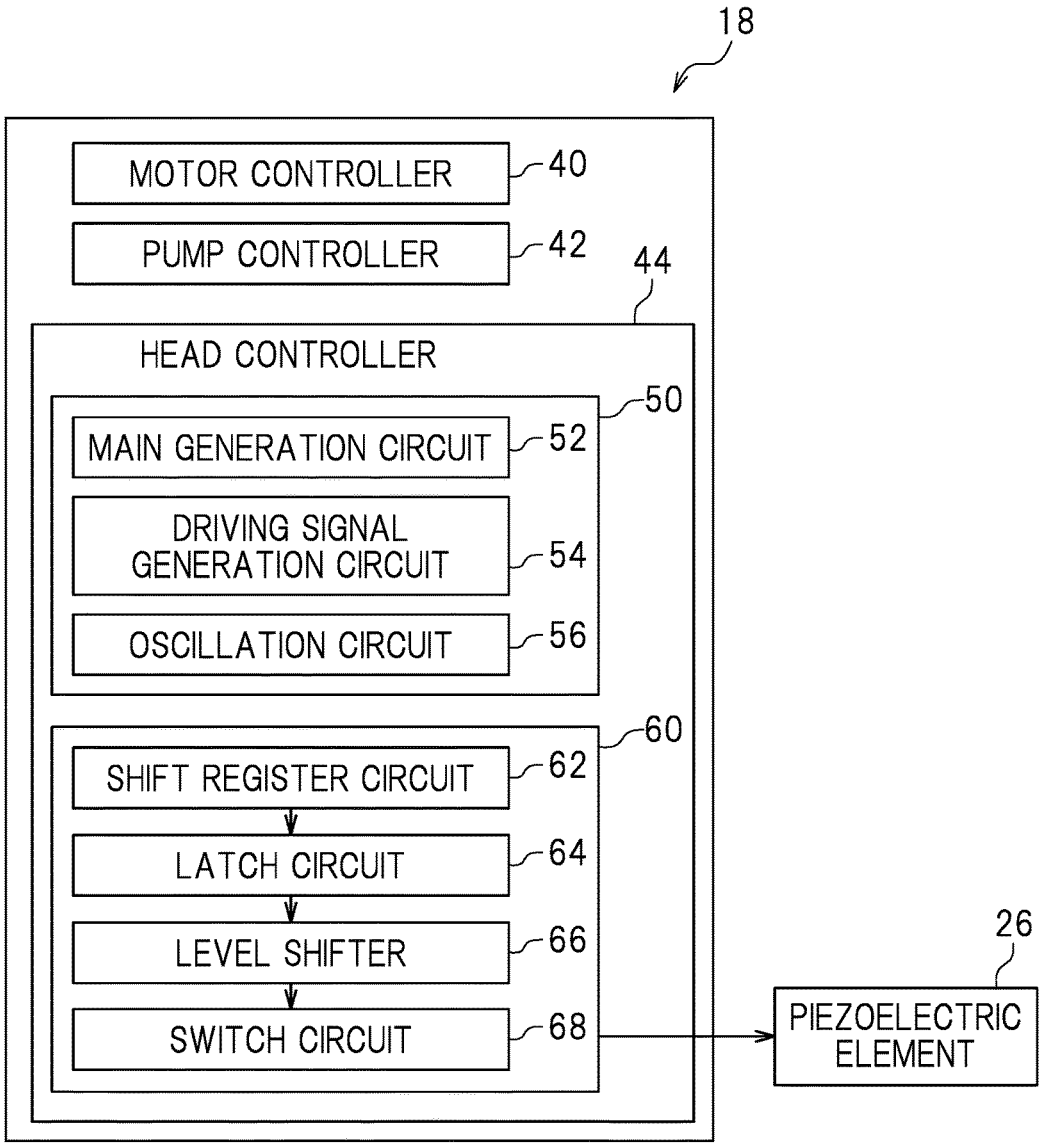
FIG. 4 is a block diagram showing a structure of a controller.

FIG. 4 is a block diagram showing a structure of the controller 18. The controller 18 includes a motor controller 40 controlling the carriage motor 8*a* of the carriage moving mechanism 8, the feed motor of the paper feeding mechanism and the like, a pump controller 42 controlling the liquid transmission pump 13 to be, for example, started or stopped, and a head controller 44 controlling, for example, supply of a driving signal to the piezoelectric element 26 of the ink injection head 15. The controllers 40, 42 and 44 operate in association with each other.

The head controller 44 includes a driving signal generator 50 and a driving signal supplier 60. The driving signal generator 50 generates gray scale data based on printing data. The driving signal supplier 60 selects one or at least two driving pulses from a plurality of driving pulses included in a common driving signal based on the gray scale data generated by the driving signal generator 50, and supplies the selected driving pulse(s) to the piezoelectric element 26. In this step, all the driving pulses or a portion of the driving pulses is selected, so that a dot having a size among various sizes, for example, a large dot, a medium dot or a small dot is printed.

The driving signal generator 50 includes a main generation circuit 52, a driving signal generation circuit 54, and an oscillation circuit 56. The oscillation circuit 56 generates a transfer clock signal CK. The driving signal generation circuit 54 generates a predetermined common driving signal COM including a plurality of driving pulses in one liquid drop injection period Pa. The common driving signal COM is pattern data of a driving waveform stored on the ROM. The driving pulses each have a pulse waveform to inject an ink drop having a predetermined amount of ink from the nozzle 25 of the ink injection head 15 or a pulse waveform for microscopically vibrating the meniscus 25*a* to such a degree as not to inject an ink drop from the nozzle 25. The common driving signal COM will be described below in detail. The driving signal generation circuit 54 generates the common driving signal COM in repetition, more specifically, in each one liquid drop injection period Pa.

The printing data is input to the main generation circuit 52 from an external device. The printing data is represented by, for example, a character code, a graphic function, image data or the like. The input printing data is developed into gray scale data corresponding to a dot pattern by the CPU. The developed gray scale data is temporarily stored on the RAM. When gray scale data SI of one row corresponding to one cycle of scanning is obtained, the gray scale data SI is output to the driving signal supplier 60 together with the clock signal CK.

The driving signal supplier 60 includes a shift register circuit 62, a latch circuit 64, a level shifter 66, and a switch circuit 68. To the shift register circuit 62, the gray scale data SI synchronized to the clock signal CK is input. To the latch circuit 64, a latch signal LAT, defining the timing ΔT at which one liquid drop injection period Pa starts, is input. When the latch signal LAT is input, the latch circuit 64 latches the gray scale data SI. The latched gray scale data SI is input to the level shifter 66 as, for example, two-bit gray scale data of "1" and "0". The level shifter 66 acts as a voltage amplifier. For example, when the gray scale data is "1", the level shifter 66 outputs an electric signal having a voltage increased to about several ten volts to the switch circuit 68. To the switch circuit 68, the common driving signal COM is input. When the switch circuit 68 is actuated, an arbitrary driving pulse is selected from the common driving signal COM, and is supplied to the piezoelectric element 26. The switch circuit 68 is coupled with the piezoelectric element 26. The piezoelectric element 26 is extended or contracted in accordance with the waveform of the above-selected driving pulse, and an ink drop is injected from the nozzle 25 based on the motion of the piezoelectric element 26. By contrast, when the gray scale data is "0", the electric signal actuating the switch circuit 68 is blocked against the level shifter 66. Therefore, the driving pulse is not supplied to the piezoelectric element 26. Alternatively, when the gray scale data is "0", a microscopically vibrating pulse to such a degree as not to inject an ink drop may be supplied.

Figure 5:
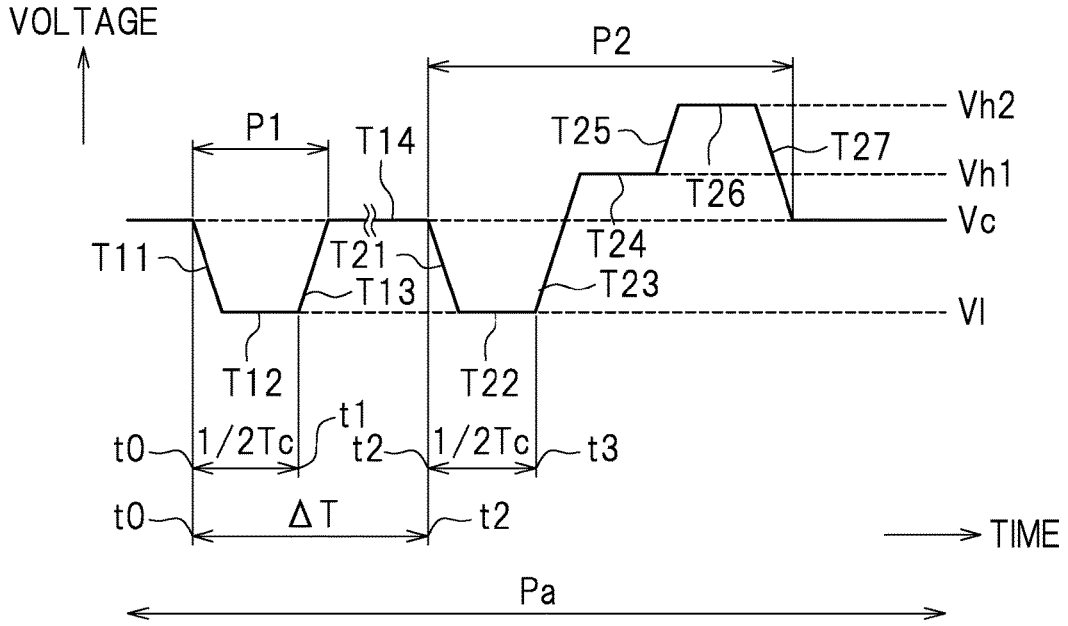
FIG. 5 shows a common driving signal according to a preferred embodiment of the present invention.

Now, the common driving signal COM will be described. FIG. 5 shows a common driving signal according to a preferred embodiment of the present invention. The common driving signal in this preferred embodiment includes two driving pulses, namely, a first driving pulse P1 and a second driving pulse P2, in one liquid drop injection period Pa. The pulses P1 and P2 have trapezoidal waveforms respectively including discharge waveforms T11 and T21 by which the potential of the piezoelectric element 26 is decreased to expand the pressure chamber 23, discharge maintaining waveforms T12 and T22 by which the potential is maintained at the decreased level for a predetermined time period to keep the pressure chamber 23 in an expanded state, and charge waveforms T13 and T23 by which the potential of the piezoelectric element 26 is increased to contract the pressure chamber 23.

In this preferred embodiment, the discharge time period (the sum of the time period in which the piezoelectric element 26 is discharged and the time period in which the potential thereof is maintained at the discharge potential) of each of the driving pulses P1 and P2 is preferably set to about ½ of the Helmholtz characteristic vibration period Tc of the ink injection head 15, for example. The timing ΔT at which the second driving pulse P2 starts is preferably set to $n \times Tc$ ($n \geq 2$) after the start of the first driving pulse P1 and also such that the speed at which a second ink drop is injected by the second driving pulse P2 is higher than, or equal to, a speed at which a first ink drop is injected by the first driving pulse P1, for example. This will be described below in detail.

The first driving pulse P1 starts at intermediate level Vc, is decreased to a first minimum potential V1 at a constant gradient (see the discharge waveform T11), and then is maintained at the first minimum potential V1 for a predetermined time period (see the discharge maintaining waveform T12). Where the start time of the discharge waveform T11 is t0 and the finish time of the discharge maintaining waveform T12 is t1, t0 and t1 are preferably set to satisfy expression (1): $t1-t0=(1/2)\times Tc$. Then, the potential of the first driving pulse P1 is increased to the intermediate potential Vc at a constant gradient (see the charge waveform T13). As a result, the first ink drop is injected from the nozzle 25. After the first driving pulse P1, the intermediate potential Vc is maintained for a predetermined time period (see an intermediate potential maintaining waveform T14).

Figure 6A:
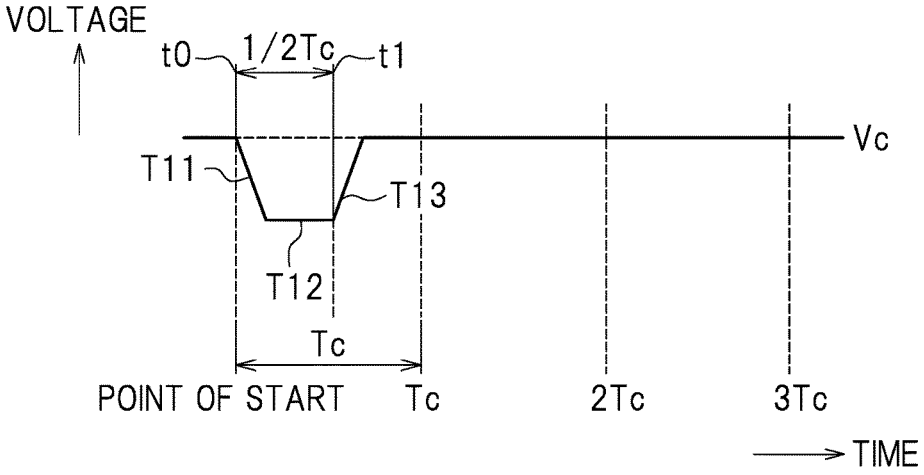
FIG. 6A shows a first driving pulse.
Figure 6B:
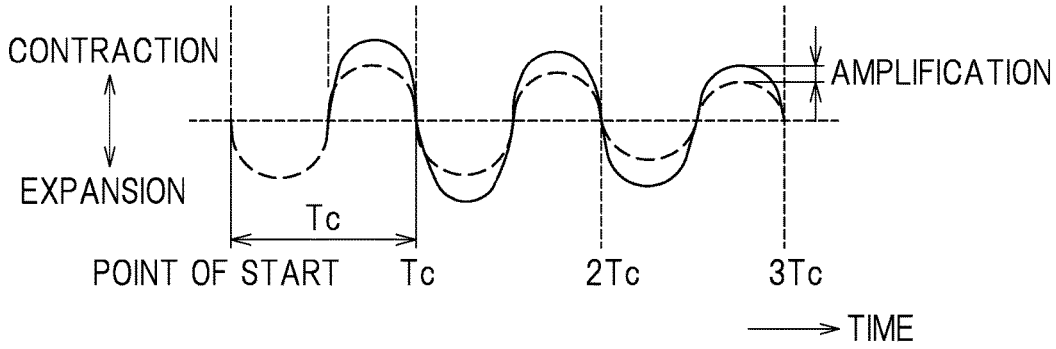
FIG. 6B shows a state of a pressure chamber in correspondence with the first driving pulse shown in FIG. 6A.

An effect provided by satisfying expression (1) will be described. FIG. 6A shows the first driving pulse P1. FIG. 6B shows a state of the pressure chamber 23 corresponding to the first driving pulse P1. The piezoelectric element 26 is contracted when the voltage value is decreased by the discharge, and is extended when the voltage value is increased by the charge. The pressure chamber 23 is expanded when the piezoelectric element 26 is contracted, and is contracted when the piezoelectric element 26 is extended. Therefore, in expression (1), $t1-t0$ represents the time period in which the pressure chamber 23 is maintained in the expanded state. The contraction of the piezoelectric element 26 causes, in the pressure chamber 23, a Helmholtz characteristic vibration of the characteristic vibration period Tc as represented by the dashed line in FIG. 6B. The piezoelectric element 26 is switched from the contracted state to the extended state at the timing satisfying the above expression (1), so that the amplitude of the Helmholtz characteristic vibration is increased as represented by the solid line in FIG. 6B. In this manner, the expansion/contraction of the pressure chamber 23 is synchronized to the Helmholtz characteristic vibration, so that the ink injection is stabilized and a relatively large ink drop is injected at a lower driving voltage. As a result, a large dot is formed on the recording paper sheet 5 with high precision.

The second driving pulse P2 starts at the timing ΔT, which is $n\times Tc$ ($n\geq 2$) after the start of the first driving pulse P1. Thus, the operation of the second driving pulse P2 is synchronized to the Helmholtz characteristic vibration period Tc, and the ink injection is stabilized. If the timing of start of the second driving pulse P2 preferably is, for example, $\{n+(1/2)\}\times Tc$, the pressure chamber 23 starts to expand at the timing when the pressure chamber 23 starts to contract at the Helmholtz characteristic vibration period Tc. In this case, the phase of a driving signal of the second driving pulse P2 does not match the phase of the Helmholtz characteristic vibration. When this occurs, the driving signal of the second driving pulse P2 cancels the vibration of the pressure chamber 23 expanding at the Helmholtz characteristic vibration period Tc. This destabilizes the meniscus 25*a*. As a result, the second ink drop does not jump at a sufficiently high speed, or is not provided in a sufficient amount of liquid to form a liquid drop. This easily causes generation of mist. For avoiding this, the second driving pulse P2 starts at the timing when the pressure chamber 23 vibrating at the Helmholtz characteristic vibration period Tc starts to expand. This prevents the operation of canceling the vibration of the pressure chamber 23 expanding at the Helmholtz characteristic vibration period Tc. Thus, the injection stability is improved. As a result, a dot of a stable size is formed on the recording paper sheet 5 at a predetermined position. Thus, high quality image recording is realized.

In this specification, "$n\times Tc$" encompasses a value exactly matching $n\times Tc$ theoretically and also a value with fluctuation or an error of Tc. For example, "$n\times Tc$" may be a theoretical value in the range of $n\times Tc-(1/8)\times Tc$ to $n\times Tc+(1/8)\times Tc$. Preferably, "$n\times Tc$" is a theoretical value in the range of $n\times Tc-(1/10)\times Tc$ to $n\times Tc+(1/10)\times Tc$.

Figure 6C:
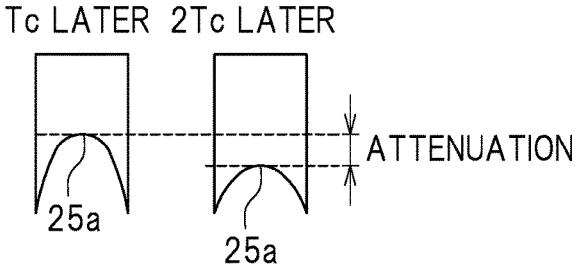
FIG. 6C shows states of a meniscus in the vicinity of the nozzle.

An effect provided by setting the timing when the second driving pulse P2 starts to 2Tc after the start of the first driving pulse P1, namely, by setting the value of n to $n\geq 2$, will be described. In the pressure chamber 23 after the first ink drop is injected, there is a residual pressure fluctuation of the piezoelectric element 26. Therefore, the meniscus 25*a* of the nozzle 25 is in a state of significantly pulled into the pressure chamber 23. The meniscus 25*a* is continuously recovered toward the opening of the nozzle 25 along time, and the amount by which the meniscus 25*a* is pulled is gradually decreased. FIG. 6C shows a state of the meniscus 25*a* when the period Tc lapses after the start of the first driving pulse P1 and a state of the meniscus 25*a* when the period 2Tc lapses after the start of the first driving pulse P1. If the second pulse P2 starts in the state of the meniscus 25*a* when the period Tc lapses, namely, in the state where the meniscus 25*a* is significantly pulled into the pressure chamber 23, the time period after the injection of the first ink drop until the start of the injection of the second ink drop is short. Therefore, a so-called pulling ejection is generated, and the liquid amount of the second ink drop is small. In addition, the resistance of the flow path in the vicinity of the nozzle 25 is increased, and thus the speed of the satellite is easily decreased after the second ink drop is injected. As a result, mist is easily generated.

In the case where the second driving pulse P2 is started when the period 2Tc lapses after the start of the first driving pulse P1 (i.e., $n\geq 2$), the second ink drop is injected in a state where the meniscus 25*a* is recovered toward the opening of the nozzle 25 to a predetermined degree. Therefore, as compared with the case where the second driving pulse P2 starts when the period Tc lapses after the start of the first driving pulse P1, the liquid amount of the second ink drop is increased. The interval between the first driving pulse P1 and the second driving pulse P2 is extended, and thus the Helmholtz characteristic vibration increased by the first driving pulse P1 is decreased along time. Therefore, the degree of contraction of the pressure chamber 23 is decreased, and the amount of ink passing the nozzle 25 per unit time is decreased. As a result, the resistance of the flow path in the vicinity of the nozzle 25 is decreased, and thus the speed of the satellite is increased. This suppresses or prevents generation of the satellite drop or the mist, and allows the second ink drop of an amount larger than, or equal to, the amount of the first ink drop to be injected stably.

There is no upper limit of the value of "n" in the above expression because the value depends on the printing speed or the like. The "printing speed" refers to the size of an area of the recording paper sheet 5 on which printing is performed in unit time, and depends on, for example, the scanning speed of the carriage 1. The printing speed may be the maximum speed realized by the printer 10 or, for example, the speed of usual printing. In, for example, a high-speed printing mode, the pressure chamber 23 is expanded or contracted with a shorter lead time than in a low-speed printing mode. Therefore, from the point of view of increasing the printing speed to improve the throughput, it is preferable that the value of n is smaller. By contrast, in order to increase the injection speed of the second ink drop to a certain degree to stabilize the injection, it is preferable that the second ink drop is injected in a state where the meniscus 25*a* is not significantly pulled into the pressure chamber 23. Therefore, in the case of, for example, a large printer for industrial use as shown in FIG. 1, the value of n may be about 10 or smaller, typically 7 or smaller, preferably 5 or smaller, more preferably 3 or smaller, and especially preferably 2.

The second driving pulse P2 starts at the intermediate level Vc, is decreased to the first minimum potential V1 at a constant gradient (see the discharge waveform T21), and then is maintained at the first minimum potential V1 for a predetermined time period (see the discharge maintaining waveform T22). In this preferred embodiment, the discharge waveform T11 and the discharge waveform T12 preferably are the same as each other, and the discharge maintaining waveform T12 and the discharge maintaining waveform T22 are the same as each other. Namely, the first driving pulse P1 and the second driving pulse P2 are preferably set to have an equal or substantially equal discharge time period, an equal or substantially equal potential reached by the discharge, and an equal or substantially equal discharge maintaining time period. Where the start time of the discharge waveform T21 is t2 and the finish time of the discharge maintaining waveform T22 is t3, t2 and t3 are preferably set to satisfy expression (2): $t3-t2=(1/2)\times Tc$. An effect provided by such a setting is the same as the effect described above regarding expression (1). As a result, the second driving pulse P2 allows the pressure chamber 23 to expand more efficiently than the first driving pulse P1. After this, the potential of the second driving pulse P2 is increased to a first maximum potential Vh1 at a constant gradient (see the charge waveform T23). As a result, the second ink drop is injected. The first maximum potential Vh1 is maintained for a predetermined time period (see a first maximum potential maintaining waveform T24).

The amount of potential change provided by the charge waveform T23 of the second driving pulse P2, namely, (Vh1−V1), is preferably set to be larger than the amount of potential change provided by the charge waveform T13 of the first driving pulse P1, namely, (Vc−V1). With such an arrangement, the second ink drop is injected at a speed higher than, or equivalent to, the speed at which the first ink drop is injected. (Vh1−V1) depends on, for example, the distance between the ink injection head 15 and the recording paper sheet 5, the scanning speed of the carriage 1 or the like, and thus is not specifically limited to any particular value. In this preferred embodiment, (Vh1−V1) preferably is set to about 1.5 (Vc−V1), so that the second ink drop is injected at a speed about 1.2 times as high as the speed at which the first ink drop is injected, for example. This allows the second ink drop to catch up with the first ink drop, so that the first ink drop and the second ink drop are merged appropriately before landing on the recording paper sheet 5 (in other words, while jumping). This also better suppresses or prevents generation of a long satellite drop or mist. Although there is no specific limitation on the value of (Vh1−V1), it is preferable that (Vh1−V1) is at most about three times as high as, or at most twice as high as, (Vc−V1), from the point of view of suppressing or preventing the vibration of the meniscus 25*a*, for example.

In this preferred embodiment, the potential of the second driving pulse P2 is further increased to a second maximum potential Vh2 at a constant gradient (see a charge waveform T25), is maintained at the second maximum potential Vh2 for a predetermined time period (see a charge maintaining waveform T26), and then is decreased to the intermediate potential Vc at a constant gradient (see a discharge waveform T27). The waveforms T25 through T27 are of an opposite phase to that of the Helmholtz characteristic vibration. In other words, because of the trapezoidal waveform formed of the waveforms T25 through T27, an expansion and contraction vibration of an opposite phase to that of the expansion and contraction vibration generated by the first and second driving pulses P1 and P2 is applied to the pressure chamber 23. This allows the kinetic energy of the meniscus 25*a* to be decreased and thus the residual vibration after the second ink drop is injected is effectively attenuated. As a result, before the first driving pulse is started in the next liquid drop injection period, the pressure chamber 23 and the meniscus 25*a* are stabilized. This allows the ink drops to be injected with a more uniform size at a more uniform speed. Thus, higher quality printing (namely, printing with little dot variance) is realized.

Now, an operation of the printer 10 will be described. When the printer 10 is started by a user, the controller 18 performs a preparation to start printing. Specifically, various types of data representing the characteristics of the ink injection head 15 (e.g., the Helmholtz characteristic vibration period Tc) are read from the ROM of the controller 18. The controller 18 also decreases the potential of the piezoelectric element 26 to the intermediate potential to expand the pressure chamber 23 microscopically. The ink injection head 15 waits in this state until a driving signal is transmitted thereto from the controller 18.

When the user instructs the printer 10 to perform a printing operation, the motor controller 40 of the controller 18 drives the feed motor of the paper feeding mechanism. As a result, the recording paper sheet 5 is transported to be located at a predetermined printing position. The motor controller 40 of the controller 18 drives the carriage motor 8*a* of the carriage moving mechanism 8. The controller 18 drives the ink injection head 15 while moving the carriage 1 in the scanning direction (left-right direction in FIG. 1). In more detail, the controller 18 inputs a driving pulse to the piezoelectric element 26 of the ink injection head 15. This causes the piezoelectric element 26 to be extended or contracted in accordance with the driving pulse, which changes the pressure in the pressure chamber 23. As a result, an ink drop having a predetermined amount of liquid is injected from the nozzle 25 at a predetermined speed. For example, when a driving signal including the first driving pulse and the second driving pulse in one liquid drop injection period is supplied to the piezoelectric element 26, the first ink drop is first injected by the first driving pulse and then the second ink drop is injected by the second driving pulse. The two ink drops are merged in the air before landing on the recording paper sheet 5, and land on the recording paper sheet 5 in a merged state to form one dot.

When one row of printing is performed, the feed motor of the paper feeding mechanism is driven and the recording paper sheet 5 is located at the next printing position. Such an operation is repeated, and the printer 10 finishes predetermined printing. When there is no input of a driving pulse to the piezoelectric element 26 anymore, the controller 18 sets the potential of the piezoelectric element 26 to zero.

Hereinafter, with reference to FIG. 7, an example of a preferred embodiment of the present invention will be described. It is not intended to limit the present invention to the following specific example.

Figure 7:
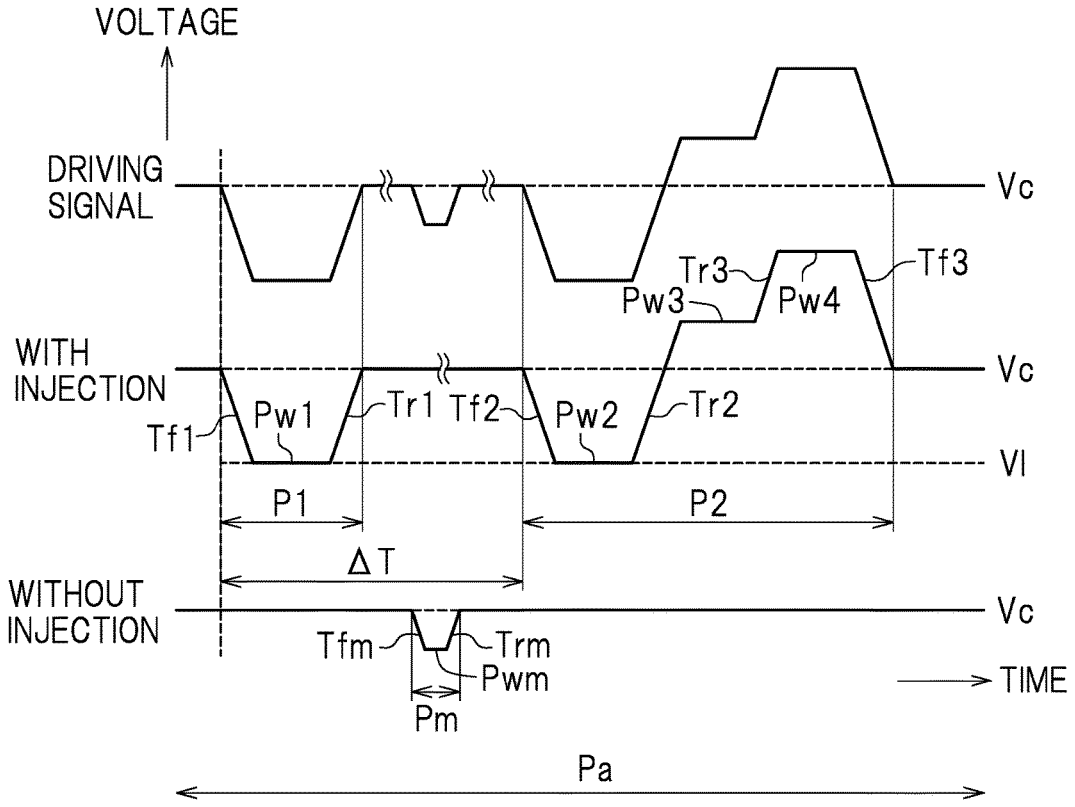
FIG. 7 shows a common driving signal in an example.

FIG. 7 shows a driving signal having a driving waveform including two driving pulses P1 and P2 to inject a liquid drop that are generated in a time-series manner in one liquid drop injection period Pa, and also including a microscopic vibration pulse Pm held between the first driving pulse P1 and the second driving pulse P2. In this preferred embodiment, the parameters preferably are set as follows.

Helmholtz characteristic vibration period Tc of the ink injection head: 6 μs

First driving pulse P1: Tf1=Tr1=1 μs; Pw1=2.25 μs; Tf1+Pw1=3.25 μs (=0.54 Tc)

Second driving pulse P2: Tf2=Tr2=Tf3=Tr3=1 μs; Pw2=2.25 μs; Pw3=Pw4=3 μs; Tf2+Pw2=3.25 μs (=0.54 Tc)

ΔT: 2Tc (12 μs) after the start of the first driving pulse P1

V1: potential reached by Tf1 by discharge=potential reached by Tf2 by discharge

Microscopic vibration driving pulse Pm: Tfm=Trm=1 μs; Pwm=0.5 μs

Where the driving frequency is 21.0 kHz and the scanning speed of the carriage 1 is 1185 mm/s, a dot of about 10 ng is formed per pixel when the ink is injected, for example. By contrast, when the ink is not injected, the meniscus 25*a* is microscopically vibrated to such a degree as not to inject any ink drop, and thus the ink in the pressure chamber 23 is stirred.

As described above, in the printer 10 in this preferred embodiment, the discharge time period (time period in which the pressure chamber 23 is in an expanded state) of each of the two driving pulses P1 and P2 included in one liquid drop injection period Pa is preferably set to about ½ of the Helmholtz characteristic vibration period Tc of the ink injection head 15. With such a setting, each of the driving pulses P1 and P2 amplifies the expansion and contraction vibration of the pressure chamber 23. As a result, the injection of the ink drop is stabilized, and a large ink drop is injected. In the printer 10, the timing ΔT at which the second driving pulse P2 starts is preferably set to 2×Tc (n≥2) after the start of the first driving pulse P1. This suppresses or prevents the residual vibration of the pressure chamber 23 after the first ink drop is injected, and allows the second ink drop to be injected in a state where the meniscus is stable. In the printer 10, the second ink drop is injected at a speed higher than, or equal to, the speed at which the first ink drop is injected. This shortens the satellite after the second ink drop is injected. As a result, generation of a satellite drop or mist, which leads to decline in the printing quality, is suppressed or prevented. Thus, the printer 10 improves the ink injection stability and improves the printing quality.

In this preferred embodiment, the first driving pulse P1 includes the discharge waveform T11 decreasing from the intermediate potential Vc to the predetermined first minimum potential V1, and the discharge maintaining waveform T12 maintained at the first minimum potential V1 for a predetermined time period. A sum of the discharge waveform T11 and the discharge maintaining waveform T12, namely, (t1−t0), is equal to (½)×Tc, for example. Similarly, the second driving pulse P2 includes the discharge waveform T21 decreasing from the intermediate potential Vc to the predetermined first minimum potential V1, and the discharge maintaining waveform T22 maintained at the first minimum potential V1 for a predetermined time period. A sum of the discharge waveform T21 and the discharge maintaining waveform T22, namely, (t3−t2), is equal to (½)×Tc, for example. The driving pulses each including the discharge maintaining waveform in this manner allow the pressure chamber 23 to expand and contract more stably.

In this preferred embodiment, the first driving pulse P1 includes the charge waveform T13 increasing from the first minimum potential V1 to the intermediate potential Vc. The second driving pulse P2 includes the charge waveform T23 increasing from the first minimum potential V1 via the intermediate potential Vc to the predetermined first maximum potential Vh1. Namely, charge waveform T23>charge waveform T13 regarding the amount of potential change. With such an arrangement, the second ink drop is injected at a speed higher than the speed at which the first ink drop is injected, so that the first ink drop and the second ink drop are merged while jumping. In addition, generation of a satellite drop or mist, which leads to decline in the printing quality, is better suppressed or prevented.

In this preferred embodiment, the second driving pulse P2 further includes the charge waveform T25 increasing from the first maximum potential Vh1 to the predetermined second maximum potential Vh2, the charge maintaining waveform T26 maintained at the second maximum potential Vh2 for a predetermined time period, and the discharge waveform T27 decreasing from the second maximum potential Vh2 to the intermediate potential Vc. This effectively attenuates the residual vibration of the pressure chamber 23. Therefore, the first driving pulse P1 is injected in the next liquid drop injection period Pa in a state where the pressure chamber 23 is stable.

In this preferred embodiment, the timing ΔT at which the second driving pulse P2 starts is preferably set to 2×Tc after the start of the first driving pulse P1 (preferably, n=2 to 5, specifically preferably n=2), for example. This increases the printing speed to improve the throughput. In addition, the ink drop is guaranteed to be injected at a sufficiently high speed to more stabilize the injection.

Preferred embodiments of the present invention have been described above. The above-described preferred embodiments are merely examples, and the present invention is carried out in any of various other preferred embodiments.

For example, in the above-described preferred embodiments, the pressure generator preferably is the piezoelectric element of the longitudinal vibration mode. The pressure generator is not limited to this. The pressure generator may be, for example, a magnetostrictive element. The piezoelectric element may be of a transverse vibration mode.

The charge/discharge time period of each driving pulse, and the value of potential reached by each driving pulse by charge/discharge, may preferably be set to any value as long as the discharge time period (time period in which the pressure chamber 23 is in an expanded state; namely, the sum of the time period in which the piezoelectric element 26 is discharged and the time period in which the potential thereof is maintained at the discharge potential) is about ½ of the Helmholtz characteristic vibration period Tc and the second liquid drop is injected at a speed higher than, or equal to, the speed at which the first liquid drop is injected. For example, in the above-described preferred embodiment, the first driving pulse P1 and the second driving pulse P2 are preferably set to be equal or substantially equal to each other in the discharge time period, the potential reached by discharge, and the discharge maintaining time period. The first driving pulse P1 and the second driving pulse P2 are not limited to this. The discharge time period may be longer in the first driving pulse P1 or in the second driving pulse P2. The potential reached by discharge may be lower in the first driving pulse P1 or in the second driving pulse P2. Typically, as the discharge time period is longer, the discharge maintaining time period tends to be shorter. In the above-described preferred embodiment, the second driving pulse P2 includes the waveforms T25 through T27 of the opposite phase to that of the Helmholtz characteristic vibration. The second driving pulse P2 does not need to include such waveforms.

In the above-described preferred embodiments, the liquid preferably is ink, for example. The liquid is not limited to this. The liquid may be, for example, a resin material, any of various liquid compositions containing a solute and a solvent (e.g., washing liquid), or the like.

In the above-described preferred embodiments, the liquid injection head preferably is the ink injection head 15 mountable on the inkjet recording device. The liquid injection head is not limited to this. The liquid injection head may be mountable on, for example, any of various production devices of an inkjet system, a measuring device such as a micropipette, or the like, to be usable in any of various uses.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid ejection device, comprising:

a liquid ejection head ejecting a liquid drop; and a controller controlling the liquid ejection head; wherein the liquid ejection head includes:

a hollow case main body provided with an opening;

a vibration plate attached to the case main body to cover the opening, the vibration plate defining a pressure chamber together with the case main body;

a pressure generator coupled with the vibration plate and expanding and contracting the pressure chamber; and a nozzle in the case main body and in communication with the pressure chamber, the nozzle allowing a liquid to flow out therefrom; wherein the controller includes:

a driving signal generator generating a driving signal including, in one liquid drop ejection period, a first driving pulse to expand and contract the pressure chamber to eject a first liquid drop and a second driving pulse to expand and contract the pressure chamber to eject a second liquid drop; and a driving signal supplier supplying the driving signal to the pressure generator of the liquid ejection head;

the first driving pulse and the second driving pulse are the only driving pulses included in the one liquid drop ejection period of the driving signal;

Tc is a Helmholtz characteristic vibration period of the liquid ejection head;

the first driving pulse maintains the pressure chamber in an expanded state for a time period of $(1/2)\times Tc\pm(1/8)\times Tc$;

the second driving pulse starts at a timing that is $n\times Tc\pm(1/8)\times Tc$ after a start of the first driving pulse, n being an integer satisfying $n\geq 2$, to maintain the pressure chamber in the expanded state for the time period of $(1/2)\times Tc\pm(1/8)\times Tc$, and to eject the second liquid drop at a speed higher than, or equal to, a speed at which the first liquid drop is ejected; and when liquid is ejected by the liquid ejection head, the driving signal generator generates, in the driving signal, the second driving pulse subsequent to the first driving pulse with no non-ejection pulse being included between the first driving pulse and the second driving pulse.

2. The liquid ejection device according to claim 1, wherein the first driving pulse and the second driving pulse each include:

a first potential decreasing waveform decreasing from an intermediate potential to a first minimum potential during a first time period; and a first minimum potential maintaining waveform maintained at the first minimum potential for a second time period; and a sum of the first time period and the second time period is equal to $(1/2)\times Tc\pm(1/8)\times Tc$.

3. The liquid ejection device according to claim 2, wherein the first driving pulse further includes a potential recovery waveform increasing from the first minimum potential to the intermediate potential; and the second driving pulse further includes a first potential increasing waveform increasing from the first minimum potential via the intermediate potential to a first locally maximum potential.

4. The liquid ejection device according to claim 3, wherein the second driving pulse further includes:

a first locally maximum potential maintaining waveform maintained at the first locally maximum potential for a predetermined time period;

a second potential increasing waveform increasing from the first locally maximum potential to a second locally maximum potential;

a second locally maximum potential maintaining waveform maintained at the second locally maximum potential for a predetermined time period; and a potential recovery waveform decreasing from the second locally maximum potential to the intermediate potential.

5. The liquid ejection device according to claim 1, wherein the second liquid drop is ejected at a speed higher than the speed at which the first liquid drop is ejected.

6. The liquid ejection device according to claim 1, wherein n satisfies $n\leq 5$.

7. The liquid ejection device according to claim 6, wherein n is 2.

8. An inkjet recording device, comprising the liquid ejection device according to claim 1.

* * * * *